US005868089A

United States Patent [19]

Inami et al.

[11] Patent Number: 5,868,089

[45] Date of Patent: Feb. 9, 1999

[54] NEEDLE THREAD RESTRAINING DEVICE IN A THREAD CUTTING SEWING MACHINE

[75] Inventors: Yuichi Inami; Minemasa Nagashima, both of Tochigi-Ken, Japan

[73] Assignee: The Singer Company N.V., Curaco, Netherlands Antilles

[21] Appl. No.: 958,973

[22] Filed: Oct. 9, 1992

[30] Foreign Application Priority Data

Nov. 14, 1991 [JP] Japan ..... 3-325098

[51] Int. Cl.[6] ..... D05B 47/00

[52] U.S. Cl. ..... 112/254; 112/292

[58] Field of Search ..... 112/291, 292, 112/254, 255

[56] References Cited

U.S. PATENT DOCUMENTS

| | | | |
|---|---|---|---|
| 2,582,211 | 1/1952 | Turner | 112/254 |
| 2,760,458 | 8/1956 | Ayers | 112/254 |
| 3,413,944 | 12/1968 | Spinrad et al. | 112/292 X |
| 3,489,115 | 1/1970 | Marforio | 112/254 X |
| 3,532,065 | 10/1970 | Marforio | 112/292 |
| 5,042,408 | 8/1991 | Suzuki et al. | 112/292 |
| 5,404,824 | 4/1995 | Hiraoka et al. | 112/254 |

*Primary Examiner*—Ismael Izaguirre
*Attorney, Agent, or Firm*—McCormick, Paulding & Huber

[57] ABSTRACT

A needle thread restraining device in a thread cutting sewing machine comprising a needle thread restraining device 18 which is disposed on a needle thread path between a needle take-up mechanism (5) and a needle thread supplying source (6) for setting the tension of the needle thread 4 to substantially zero when the thread cutting mechanism (9) does not operate and to a given value when the thread cutting mechanism (9) operates, and a tension nullification means 31 for setting the tension applied by a tension regulator (10) to a given value when the thread cutting mechanism (9) does not operate and for nullifying the tension applied by the tension regulator when the thread cutting mechanism operates. The amount of the needle thread to be drawn under the work can be set properly and independently, nullifying of the tension set by the tension discs when the sewing thread is cut by the thread cutting mechanism. Accordingly, the needle thread restraining device in a thread cutting sewing machine of the present invention has an effect that the needle thread, which remains at the needle side and the work side after the completion of cutting of the sewing thread, can be set to have the necessary and sufficient length with ease and accuracy irrespective of the kind of works, the state of seams and the kind of needle thread.

2 Claims, 5 Drawing Sheets

NEEDLE THREAD RESTRAINING DEVICE IN A THREAD CUTTING SEWING MACHINE

BACKGROUND OF THE INVENTION

1. Field of the Invention

The present invention relates to a needle thread restraining device in a thread cutting sewing machine.

2. Prior Art

A sewing machine provided with a thread cutting mechanism is defined as a thread cutting sewing machine. In a conventional thread cutting sewing machine, the sewing threads comprising a needle thread and a bobbin thread is cut by a knife under a needle plate on which a work is placed during the time when a needle rises from the surface of the work and moves to an upper stopping position after a series of sewing operations are completed.

It would be ideal if the needle thread which remains at the needle side after the sewing thread is cut by the thread cutting mechanism, has the necessary and sufficient length so as to form a proper seam at the first stitch of the successive start of the sewing operation. If the length of the remaining needle thread is short, there is a possibility that the needle thread comes out of the needle to thereby stop the sewing operation. On the contrary, if the remaining needle thread is long, the end of the needle thread remains long on the first seam of the successive sewing work, thereby deteriorating the quality of the sewn product, which involves the necessity of manual cutting and removing of the end of the needle thread depending on the specification of the sewn product.

To solve such a drawback, an appropriate resistance involved in feeding the sewing thread is applied to the needle thread for drawing an appropriate amount of the needle thread under the needle plate when the needle cutting mechanism operates. A tension regulator or an auxiliary tension regulator is provided as a means for applying such resistance wherein the tension applied by the tension regulator of the sewing machine is nullified during the time when the thread cutting mechanism operates and accordingly a given tension is applied to the needle thread by the auxiliary tension regulator alone to thereby regulate the amount of the needle thread to be drawn under the needle plate. The auxiliary tension regulator is provided between the tension regulator and a spool serving as the needle thread supplying source for always applying the given tension to the needle thread.

However, according to the needle thread restraining device of the conventional thread cutting sewing machine, since the given tension is always applied to the needle thread which is drawn under the needle plate by the auxiliary tension regulator, the tension applied by the auxiliary tension regulator tends to influence unfavorably upon the work depending on the specification of the work. Concretely, it is very difficult to harmonize the balance of the seams between the needle thread with the bobbin thread relating to the tension to be applied to the needle thread with the appropriate length of the needle thread after the sewing thread is cut, which causes the problem in a sewing mill. Particularly, in case of a thin work, the tension applied by the auxiliary tension regulator influences delicately upon the balance of the seams of the needle thread and the bobbin thread.

SUMMARY OF THE INVENTION

It is an object of the present invention to solve the drawback of the conventional needle thread restraining device in the thread cutting machine.

A needle thread restraining device in a thread cutting sewing machine provided with a thread cutting mechanism for cutting a needle thread and bobbin thread under a work after the work was subjected to a series of sewing operations, said needle thread restraining device in a thread cutting sewing machine comprises a needle thread restraining device which is disposed on a needle thread path between a needle take-up mechanism and a needle thread supplying source for setting the tension of the needle thread to substantially zero when the thread cutting mechanism does not operate and to a given value when the thread cutting mechanism operates and a tension nullification means for setting the tension applied by a tension regulator to a given value when the thread cutting mechanism does not operate and for nullifying the tension applied by the tension regulator when the thread cutting mechanism operates.

The work is subjected to the series of sewing operations in the state where the tension regulator applies the tension to the needle thread at the given value and the needle thread restraining device applies zero tension to the needle thread.

Accordingly, while the work is subjected to the series of the sewing operations, the tension is applied to the needle thread by only the tension regulator so that appropriate tension can be easily applied in advance to the needle thread so as to balance the seams of the needle thread and the bobbin thread.

Successively, when the thread cutting mechanism cuts the sewing thread under the work after the series of sewing operations are completed, the nullification means operates to thereby nullify the tension applied by the tension regulator and the needle thread restraining device applies the given tension to the needle thread. As a result, the appropriate tension adapted for the kind of the needle thread is applied to the needle thread by the needle thread Restraining device alone, thereby feeding the sewing thread properly so that the thread cutting mechanism can cut the sewing thread.

DESCRIPTION OF THE PREFERRED EMBODIMENT

First Embodiment (FIG. 1 to 7)

Figure 1:
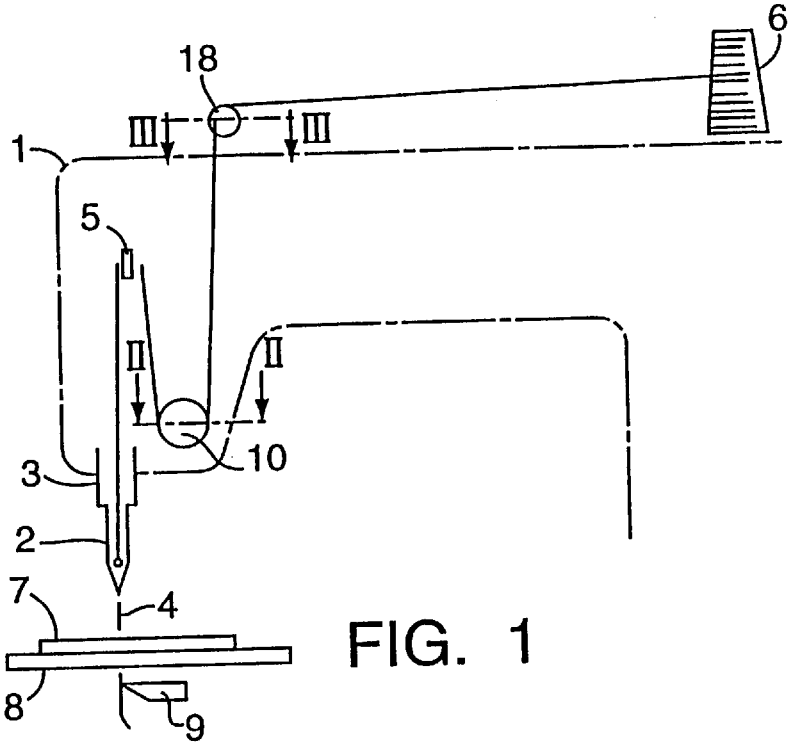
FIG. 1 is a front view of a thread cutting sewing machine provided with a needle thread restraining device according to the first embodiment of the present invention.

A needle thread restraining device in a thread cutting sewing machine according to the first embodiment of the present invention will be described with reference to FIGS. 1 to 7.

The needle thread restraining device in a thread cutting sewing machine comprises elements set forth hereunder. A needle bar 3 is supported by the known arm of the sewing machine so as to be movable vertically. A needle 2, through which a needle thread passes, is mounted on the tip end of the needle bar 3 and a pressure bar, not shown, having a pressure foot (not shown) is disposed close to the needle bar 3. The arm 1 houses therein a needle thread take-up mechanism which operates accompanied by the rotation of a main shaft, not shown, and has a needle thread take-up 5. The needle thread 4, which is guided from a spool 6 serving as a needle thread supplying source along a needle thread restraining device 18 and a tension regulator 10, passes through the needle thread take-up 5 and stretches to the needle 2 of the needle bar 3. There is provided a thread path from the spool 6 to the needle 2. There are provided a throat plate 8, on which a work 7 is placed, and cutting knife 9 disposed under the throat plate 8 for serving as a thread cutting mechanism. The sewing threads, comprising the needle thread 4 and a bobbin thread, are cut under the work 7 after the work 7 was subjected to a series of sewing operations.

Figure 4:
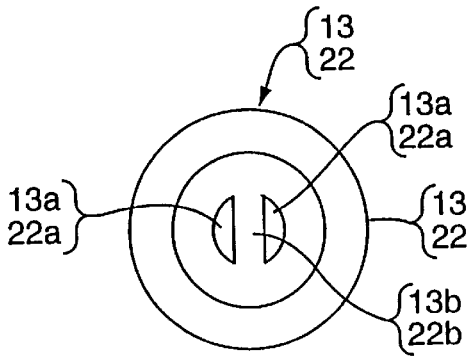
FIG. 4 is an enlarged view showing a spring seat disc as illustrated in FIG. 2.

A tension regulator 10 is fixed to the front surface of the arm 1 and comprises a support shaft 15 having a split portion 15*a* which is formed by splitting the tip end of the support shaft 15 in two along the central axis thereof, a pair of tension discs 11 and a spring seat disc 13 which are respectively engaged in and supported by the support shaft 15, and a tension regulating thumb nut 14 which is screwed in male screw portions of the split portion 15*a* of the shaft 15 for regulating the resiliency of the tension spring 12 disposed and compressed between the spring seat disc 13 and the tension regulating thumb nut 14. With such an arrangement, the resiliency of the tension spring 12 can be varied by varying the amount of screwing of the tension regulating thumb nut 14, thereby regulating the force to clamp the needle thread 4 by the pair of tension discs 11 so that the tension applied to to the needle thread 4 can be adjusted strong or weak. The spring seat disc 13 has two perforation holes 13*a* at the center portion thereof through which the split portion 15*a* of the shaft 15 enter and a contact surface 13*b* for contacting a tension releasing pin 16, described later, is formed between both perforation holes 13*a* as illustrated in FIG. 4.

The tension regulator 10 has a tension nullification means 31 which renders the tension applied to the needle thread 4 by the tension regulator 10 substantially zero. The tension nullification means 31 comprises a tension releasing pin 16, which is inserted between the base end of the split portion 15*a* of the support shaft 15 and through the base end of the support shaft 15 and is slidable in the support shaft 15, and an actuation plate 17 which operates at the time of cutting the sewing thread while interlocked with the thread cutting mechanism. The tension nullification means 31 sets the tension applied to the needle thread 4 by the tension regulator 10 to a given value when the thread cutting mechanism does not operate and nullifies the tension applied to the needle thread 4 by the tension regulator 10 when the thread cutting mechanism operates. Accordingly, the tip end of the tension releasing pin 16 is positioned at the contact surface 13*b* of the spring seat disc 13 while the base end of the tension releasing pin 16 protrudes inside the arm 1. The base end of the tension releasing pin 16 protruding inside the arm 1 is positioned at the actuation plate 17.

Figure 2:
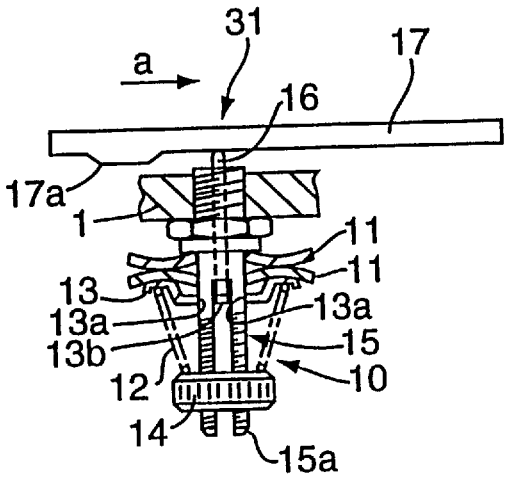
FIG. 2 is a cross-sectional view taken along II—II of FIG. 1.

When the actuation plate 17 interlocked with the operation of the thread cutting mechanism operates in the direction of the arrow a, a protrusion 17*a* of the actuation plate 17 contacts the base end of the tension releasing pin 16 so that the tension releasing pin 16 is pushed outside the arm 1 and the spring seat disc 13 is also pushed out while the tension spring 12 is pushed back to be compressed. As a result, the tension applied to the needle thread 4 clamped by the pair of tension discs 11 can be nullified. If the actuation plate 17 returns to the position as illustrated in FIG. 2 when the thread cutting mechanism does not operate, and the protrusion 17*a* is separated from the tension releasing pin 16, the tension applied to the needle thread 4 is recovered by the tension regulator 10.

Figure 3:
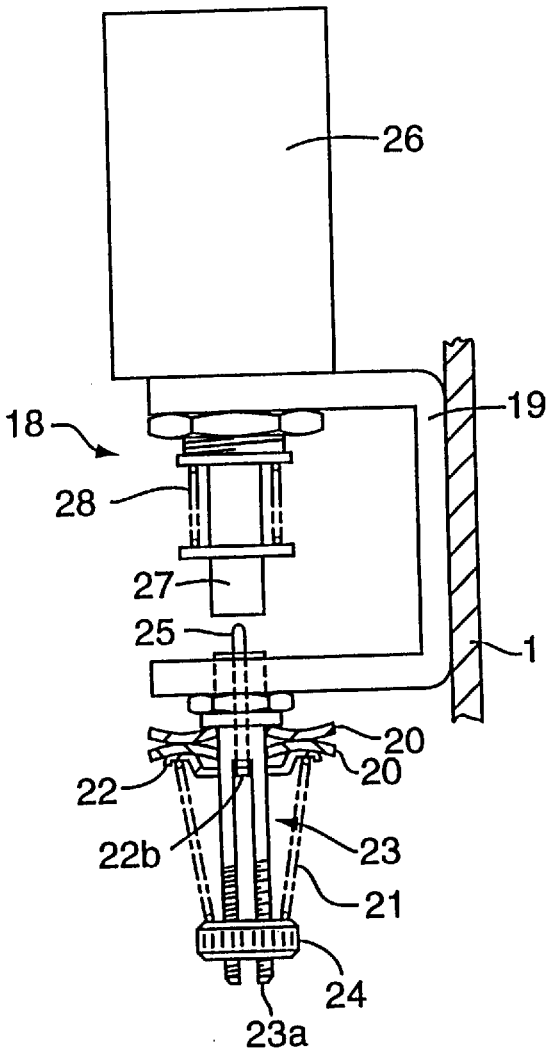
FIG. 3 is a cross-sectional view taken along III—III of FIG. 1.

The needle thread restraining device 18, provided between the tension regulator 10 and the spool 6, has a function to set the tension of the needle thread 4 to substantially zero when the thread cutting device does not operate and to set a given value when the thread cutting device operates. As illustrated in FIG. 3, the needle thread restraining device 18 fixed to the arm 1, comprises a U-shaped bracket 19, a support shaft 23 having a split portion 23*a* which is split in two in the central axial direction at the tip portion thereof and fixed to one side of the lower portion of the bracket 19, a pair of retaining discs 20 and a spring seat disc 22 engaged with the support shaft 23 and supported by the needle thread restraining spring 21, and a needle thread restraining adjusting nut 24 which is screwed in male screw portions of the split portion 23*a* of the shaft 23 for regulating the resiliency of the needle thread restraining spring 21 disposed and compressed between the spring seat disc 22 and the needle thread restraining adjusting nut 24.

Accordingly, the resiliency of the needle thread restraining spring 21 can be varied by varying the screwing amount of the needle thread restraining adjusting nut 24, so that the tension applied to the needle thread 4 which is clamped by the pair of retaining disc 20, can be regulated strong or weak.

As illustrated in FIG. 4 the spring seat disc 22 has two perforation holes 22*a* at the central portion thereof through which the split portion 23*a* is inserted and a contact surface 22*b* for contacting a needle thread restraining actuation pin 25, described later, between two perforation holes 22*a*. The needle thread restraining actuation pin 25 is slidably inserted into the center of the base end of the split portion 23*a* and through the base end of the support shaft 23. The tip end of the needle thread restraining actuation pin 25 is positioned at the contact surface 22*b* of the spring seat disc 22 and the base end of the needle thread restraining actuation pin 25 protrudes from the other side of the lower portion of the bracket 19.

A solenoid 26 serving as a driving device of the needle thread restraining actuation pin 25 (FIG. 3 shows a backward operation) is fixed to the upper side of the bracket 19. A plunger 27 of the solenoid 26 is positioned at the base end of the needle thread restraining actuation pin 25 and presses and moves the needle thread restraining actuation pin 25 and the spring seat disc 22 against the resiliency of the needle thread restraining spring 21 by the returning operation of the return spring 28 when the solenoid 26 does not operate, so that the plunger 27 renders the tension applied to the needle thread 4 which is clamped by the pair of retaining disc 20, substantially zero to thereby release the needle thread restraining operation. The solenoid 26 may be replaced by a pneumatic cylinder for constituting the driving device.

Figure 5:
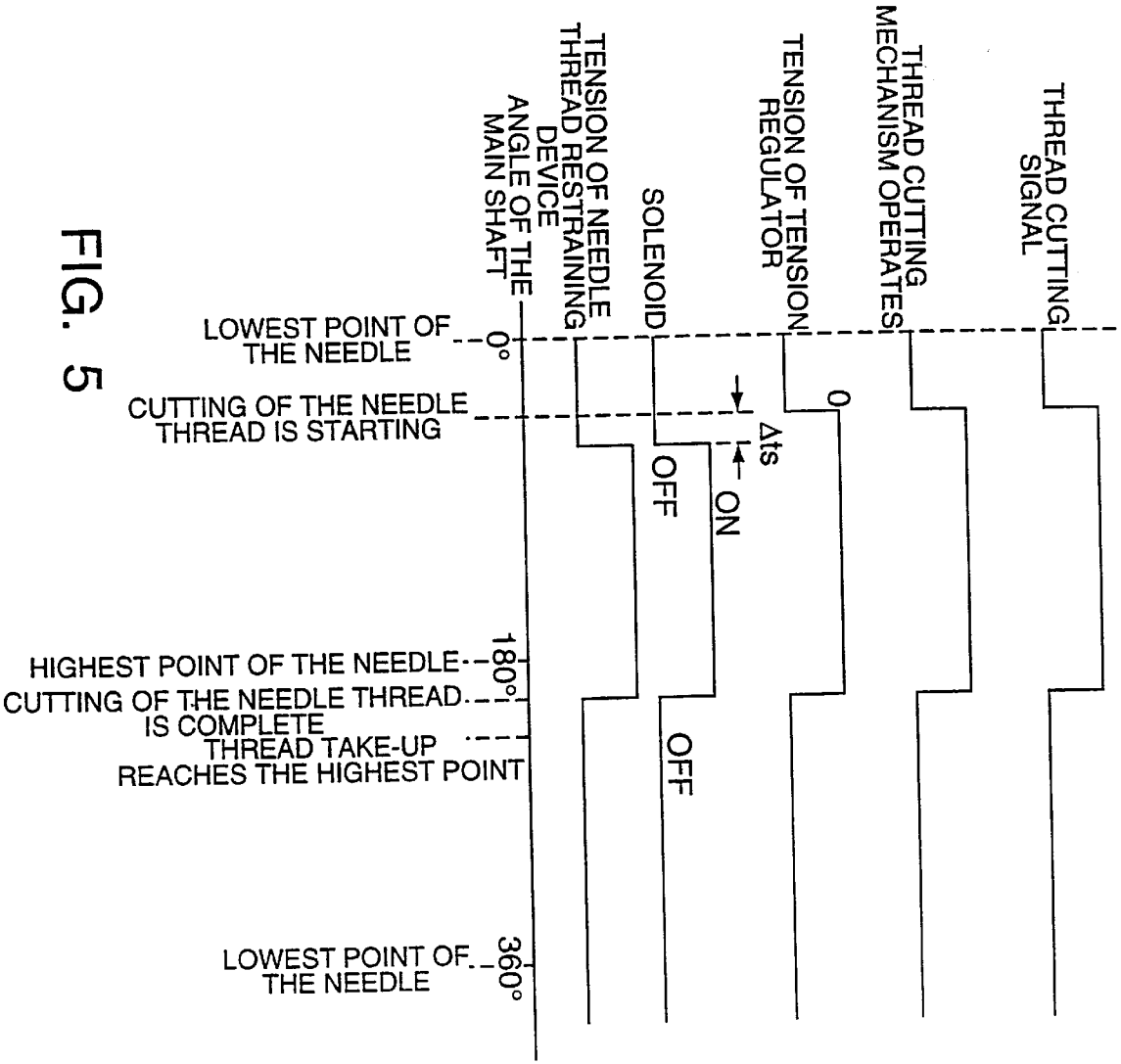
FIG. 5 is a timing chart showing the operation of the needle thread restraining device of FIG. 1.

An operation of the needle thread restraining device having the arrangement set forth above will be described with reference to a timing chart of FIG. 5.

The actuation plate 17 is positioned as shown in FIG. 2 when the work 7 is subjected to the sewing operation wherein the protrusion 17*a* of the actuation plate 17 is not in contact with the tension releasing pin 16. The given tension is applied to the needle thread 4 which is clamped by the pair of tension discs 11, by way of the spring seat disc 13 pushed up by the resiliency of the tension spring 12. The needle thread restraining device 18 does not perform the thread restraining operation when the solenoid 26 does not operate.

At this state, when the angle of the main shaft of the sewing machine reaches a predetermined value from the lowest point of the needle (0°), in that case the needle 2 rises from the last stitch after the work 7 was subjected to the series of sewing operation, a thread cutting mechanism starts to operate upon reception of a thread cutting signal to catch the sewing threads under the work 7 and draw out the sewing threads as long as necessary for cutting and thereafter cut the sewing threads using the knife 9.

When the thread cutting mechanism starts to operate, the actuation plate 17 as shown in FIG. 2 moves in the direction of the arrow a so that the protrusion 17*a* of the actuation plate 17 pushes in the tension releasing pin 16, the tension spring 12 is compressed so as to push out the spring seat disc 13. As a result, the needle thread 4 is released from clamping by the tension discs 11, whereby the tension applied by the tension regulator 10 is nullified. Accordingly, the needle thread 4 can be easily drawn under the work 7.

The solenoid 26 is driven at the same time when the thread cutting mechanism operates or driven by a needle thread restraining signal which is supplied at a time $\Delta t_s$. behind the time set by a time delay circuit such as a timer provided in a control box, not shown, so that the plunger 27 moves to compress the return spring 28. Accordingly, the restraint of the spring seat disc 22 by the needle thread restraining actuation pin 25 is released so that the resiliency of the needle thread restraining spring 21 is applied to the retaining disc 20 by way of the spring seat disc 22. An appropriate tension which is previously set by turning the needle thread restraining adjusting nut 24 is applied to the needle thread 4, which passes between two thread retaining discs 20.

At the state where the tension nullification means 31 renders the tension which is applied to the needle thread 4 by the tension regulator 10, substantially zero and the needle thread restraining device 18 alone applies the given tension to the needle thread 4, the knife 9 of the thread cutting mechanism cuts the needle thread 4. That is, since the needle thread 4 is drawn out at the state where the given tension is applied thereto by merely the needle thread restraining device 18 and cut by the knife 9, it is cut at the state where the appropriate length of the needle thread 4 is drawn out, namely, the appropriate length of the needle thread remains on the work 7, and the length thereof sufficient to perform a proper stitch at the first seam on the succeeding work 7 which remains on the needle 2.

After the angle of the main shaft passes the highest point (180°) of the needle, the cutting of the needle thread 4 is completed, and the needle thread take-up 5 reaches the highest point.

Figure 6:
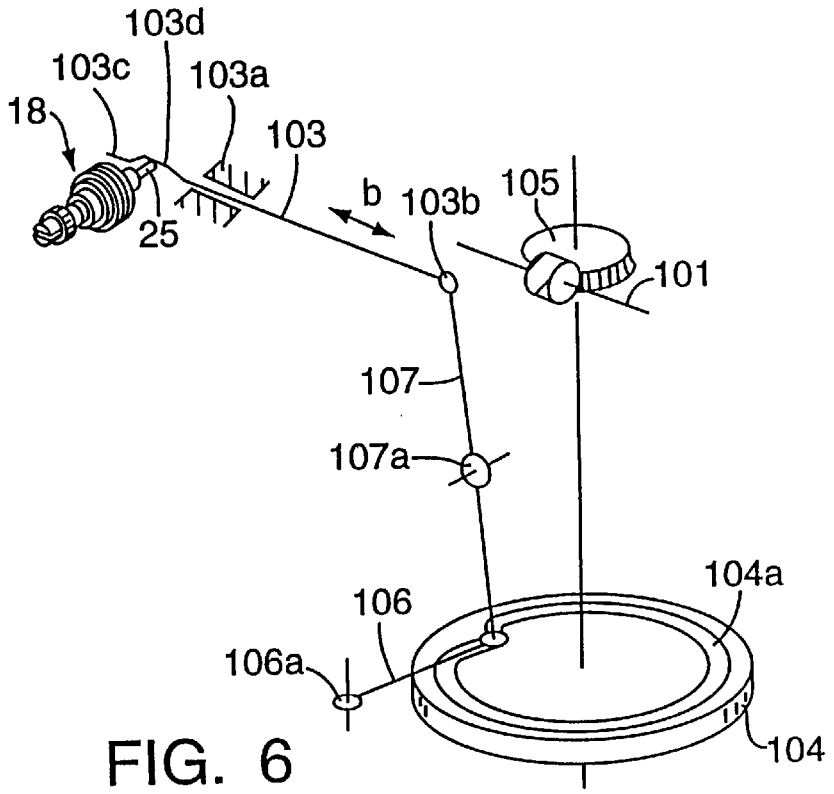
FIG. 6 is a perspective view of a modified driving mechanism of the needle thread restraining pin of the needle thread restraining device.

A modified driving mechanism of the needle thread restraining actuation pin 25 of the needle thread restraining device 18 will be described with reference to FIG. 6.

The driving mechanism comprises a cam plate 104 which is rotated a train of gears 105 drived by a main shaft 101 of the sewing machine and a driven arm 106 which reciprocally moves along a cam groove 104*a* defined on the cam plate 104. The driven arm 106 can swing about a swinging fulcrum 106*a* provided on the arm 1. The reciprocal motion of the driven arm 106 is transmitted to a swing lever 107 which is swingable about a swinging fulcrum 107*a* provided on the arm 1 and thereafter transmitted to an actuation plate 103 which is coupled to the swing lever 107 by way of a hinge pin 103*b*.

Since the actuation plate 103 is guided by a linear guide 103*a* provided on the arm 1 in the direction of the arrow b, a protrusion 103*c* of the actuation plate 103 pushes the needle thread restraining actuation pin 25 so that a recess portion of the actuation plate 103 releases the pushing of the needle thread restraining actuation pin 25. Accordingly, the tension applied to the needle thread 4 which passes between two retaining discs 20 is nullified while the appropriate tension which is previously set by turning the needle thread restraining adjusting nut 24 can be applied to the needle thread 4 whereby the needle thread restraining operation can be performed.

Figure 7:
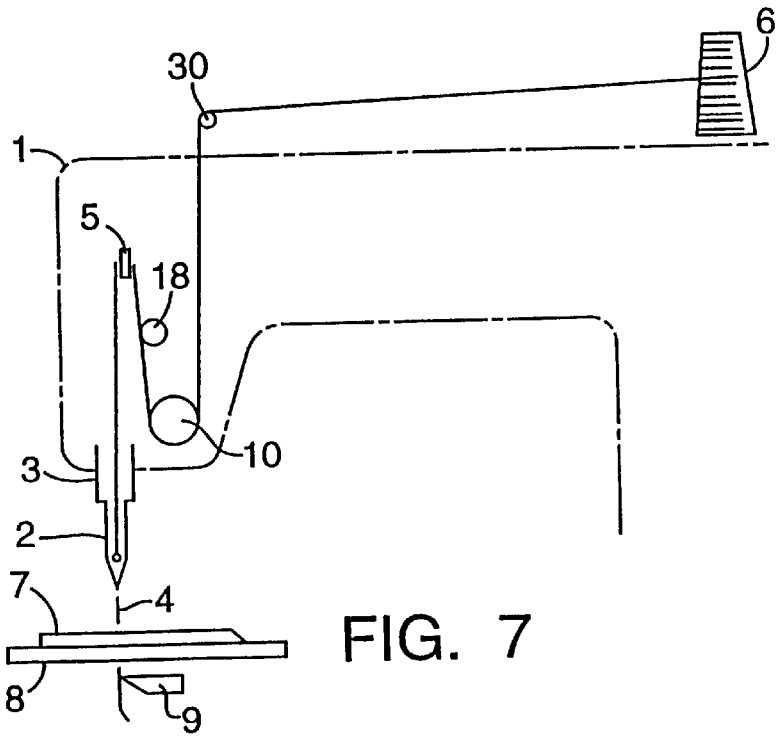
FIG. 7 is a front view of the needle thread restraining device according to the first embodiment of the present invention wherein the needle thread restraining device is mounted in the location different from the same in FIG. 1.

FIG. 7 is a view of a needle thread restraining device 18 which is mounted in the location different from that in the arm 1 of the first embodiment of the present invention set forth above, i.e., on the thread path of the needle thread 4 between the needle thread take-up 5 and the tension regulator 10. A guide 30 for the needle thread 4 is added to this modified embodiment due to the displacement of the needle thread restraining device 18. The same effect as that of the preceding embodiment can be obtained too with this arrangement since the tension of the needle thread 4 can be set at a given value or nullified by the needle thread restraining device 18 provided between the needle thread take-up 5 and the tension regulator 10.

Figure 8:
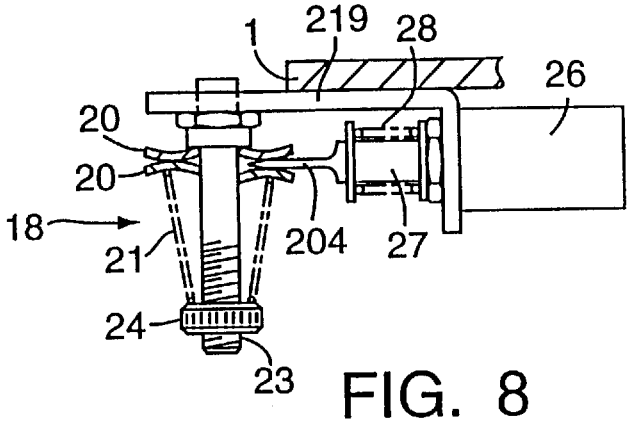
FIG. 8 is a plan view of a needle thread restraining device according to the second embodiment of the present invention.
Figure 9:
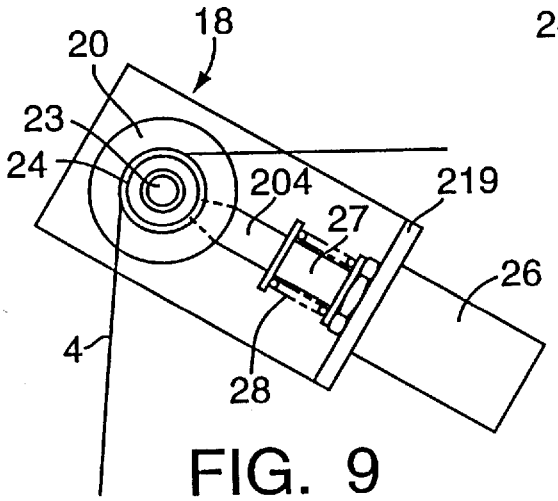
FIG. 9 is a front view of FIG. 8.

Second Embodiment (FIGS. 8 and 9)

Another modification of the arrangement of the needle thread restraining device 18 is illustrated in FIGS. 8 and 9. In this arrangement, the needle thread restraining device 18 is fixed to the arm 1 and comprises an L-shaped bracket 219, a support shaft 23 fixed to one end of the bracket 219, the pair of retaining discs 20 which are engaged in and supported by the support shaft 23, and the needle thread restraining adjusting nut 24 which are screwed by the support shaft 23 for regulating the resiliency of the needle thread restraining spring 21 which is interposed and compressed between one of the retaining discs 20 and the needle thread restraining adjusting nut 24. In such an arrangement, the resiliency of the needle thread restraining spring 21 can be varied by varying the screwing amount of a needle thread restraining adjusting nut 24 so that the tension applied to the needle thread 4, which is clamped by the pair of retaining discs 20, can be regulated. The split portion 23*a* of the supporting shaft 23 and the spring seat disc 22 are omitted.

The solenoid 26 serving as a driving unit of a tongue member 204 is fixed to the other side of the bracket 219. A tip end of the tongue member 204 fixed to the plunger 27 of the solenoid 26 is positioned between the pair of retaining discs 20. When the solenoid 26 does not operate, the tongue member 204 pushes off the pair of tension discs 20 against the resiliency of the needle thread restraining spring 21 so that the tension of the needle thread 4 clamped between the pair of tension discs 20 is rendered zero to thereby release the needle thread restraining operation. When the solenoid 26 moves backward, the tongue member 204 comes out from the space between the pair of retaining discs 20, the needle thread 4 is clamped by the pair of retaining discs 20 to which the resiliency of the needle thread restraining spring 21 is applied so that the needle thread 4 is restrained under the given tension.

Figure 10:
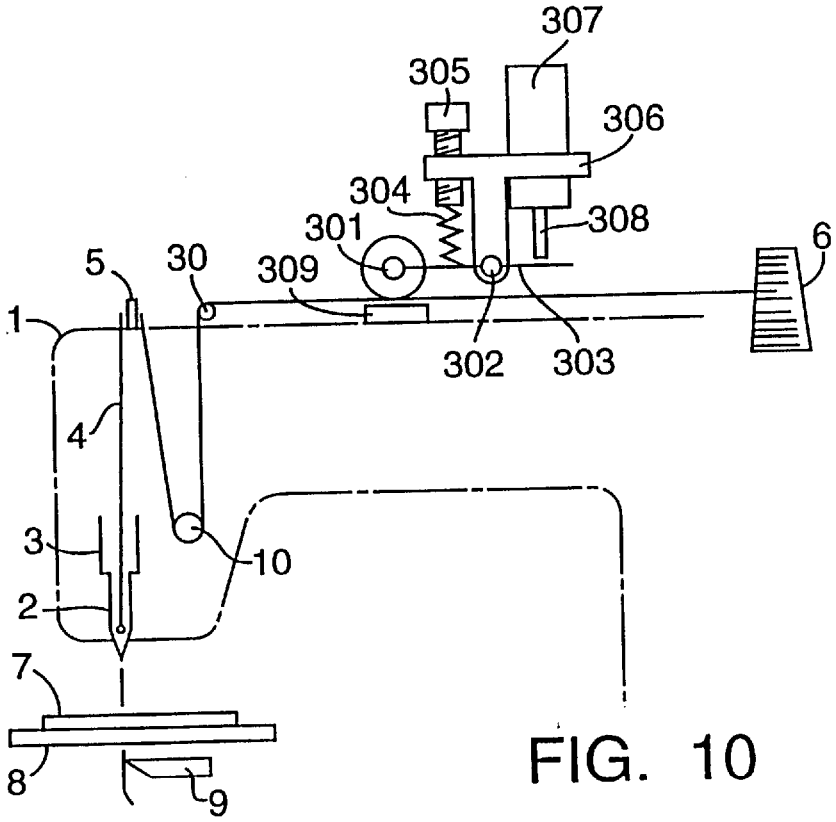
FIG. 10 is a front view of a thread cutting sewing machine provided with a needle thread restraining device according to the third embodiment of the present invention.

Third Embodiment (FIG. 10)

A needle thread restraining device 18 in a thread cutting sewing machine according to the third embodiment of the present invention will be described with reference to FIG. 10.

A bracket 306 is fixed to the arm 1 and has a roller arm 303 which turns about a fulcrum 302 provided thereat. A roller 301 is rotatably supported by the tip end of the roller arm 303 and presses the needle thread 4 toward a pressing portion 309 on the arm 1 by the resiliency of a spring 304. A regulating screw 305 is screwed in male screw portions of the bracket 306 for regulating the resiliency of the spring 304 which presses the needle thread 4. Since the tip end of a plunger 308 of a solenoid 307 attached to the bracket 306 is positioned at the other end of the roller arm 303, the restraint of the needle thread 4 can be switched to an inoperative state or an operative state when the plunger 308 contacts or does not contact the roller arm 303. That is, when the needle thread restraining operation is performed, the needle thread 4 is clamped and pressed between the roller 301 to which the given resiliency of the spring 304 is applied and the pressing portion 309 so that the given tension is applied to the needle thread 4. When the needle thread restraining operation is not performed, a gap is defined between the roller 301 and the pressing portion 309 to thereby rendering the tension applied to the needle thread 4 zero.

As evident from the above description, the needle thread restraining device in a thread cutting sewing machine according to the present invention is provided with the needle thread restraining device to dispense with the tension to be applied to the needle thread at the normal sewing operation but to necessitate the tension only when the sewing thread is cut, the amount of the needle thread to be drawn under the work can be set properly and independently, nullifying of the tension set by the tension discs when the sewing thread is cut by the thread cutting mechanism. Accordingly, the needle thread restraining device in a thread cutting sewing machine of the present invention has such an excellent effect that the needle thread which remains at the needle side and the work side after the completion of cutting of the sewing thread, can be set to have the necessary and sufficient length with ease and accuracy irrespective of the kind of works, the state of seams and the kind of needle thread.

What is claimed is:

1. A needle thread restraining device in a thread cutting sewing machine provided with a thread cutting mechanism for cutting a needle thread and bobbin thread under a work after the work was subjected to a series of sewing operations, said needle thread restraining device in a thread cutting sewing machine comprising:

a tension regulator disposed along a needle thread path for selectively applying a tension to the needle thread;

a needle thread restraining device which is disposed on the needle thread path between a needle take-up mechanism and a needle thread supplying source for setting the tension of the needle thread to substantially zero when the thread cutting mechanism does not operate and to a given value when the thread cutting mechanism operates; and a tension nullification means for setting the tension applied by the tension regulator to a given value when the thread cutting mechanism does not operate and for nullifying the tension applied by the tension regulator when the thread cutting mechanism operates.

2. A needle thread restraining device as defined in claim 1, wherein the needle thread restraining device is disposed between the needle thread supplying source and the tension regulator.

* * * * *